US009462830B2

(12) United States Patent
Liu

(10) Patent No.: US 9,462,830 B2
(45) Date of Patent: Oct. 11, 2016

(54) ELECTRONIC CIGARETTE

(75) Inventor: Qiuming Liu, Gang'an Dongguan (CN)

(73) Assignee: HUIZHOU KIMREE TECHNOLOGY CO., LTD., Shenzhen (CN)

( * ) Notice: Subject to any disclaimer, the term of this patent is extended or adjusted under 35 U.S.C. 154(b) by 984 days.

(21) Appl. No.: 13/517,108

(22) PCT Filed: Jul. 12, 2011

(86) PCT No.: PCT/CN2011/077077

§ 371 (c)(1),
(2), (4) Date: Jun. 19, 2012

(87) PCT Pub. No.: WO2013/007020

PCT Pub. Date: Jan. 17, 2013

(65) Prior Publication Data

US 2013/0014772 A1 Jan. 17, 2013

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 131/270, 273, 194; 128/202.21
See application file for complete search history.

(56) References Cited

U.S. PATENT DOCUMENTS 2,939,807 A * 6/1960 Needham ..... H05B 3/262 216/16
5,388,574 A * 2/1995 Ingebrethsen .... A61M 15/0085 128/200.16

* cited by examiner

*Primary Examiner* — Dionne Walls Mayes
(74) *Attorney, Agent, or Firm* — Steptoe & Johnson LLP

(57) ABSTRACT

An electronic cigarette includes a storage tank filled with extractant and an atomization device. The electronic cigarette further comprises a device for heating tobacco, which includes a heating mechanism and a heated chamber for loading cigarette or tobacco. The heating mechanism comprises a heating element and a heater circuit for controlling the heating element to be heated to a set temperature range. An inlet of the heated chamber is connected to an outlet of the atomization device, and its outlet is connected with an opening for a suction nozzle. When the electronic cigarette is working, the extractant is atomized by the atomization device and then guided into the heated chamber. The heat produced by the heating element is applied to the cigarette or tobacco in the heated chamber to generate nicotine. The nicotine and atomized extractant are mixed together and then sucked out through the opening for the suction nozzle.

8 Claims, 5 Drawing Sheets

ELECTRONIC CIGARETTE

CLAIM FOR PRIORITY

This application claims priority under 35 USC 371 to International Application No. PCT/CN2011/077077, filed on Jul. 12, 2011, which is hereby incorporated by reference in its entirety.

FIELD OF THE INVENTION

The present invention relates to an-electronic cigarette, particularly, to an electronic cigarette without open fire but with real cigarette flavor.

BACKGROUND OF THE INVENTION

There are many consumer groups who are highly dependent on cigarette all over the world. When these smokers are smoking, they light a cigarette through open fire, inhale the nicotine, tar and other impurities in the cigarette into their lungs and then blow them out. Such harmful substances like nicotine, tar and other impurities that are blown out cause the people around to suffer from passive smoking. Thus, they bring about bad effect on the environment and the health of people around. Moreover, the burning butts not only pollute the environment but also start a fire easily.

For the-electronic cigarette designed for making the smokers quit smoking on the market, since it is the extractant without the taste of nicotine in the cigarette that is inhaled by smokers, those smokers undesired to quit smoking are unwilling to have such simulation cigarette.

SUMMARY OF THE INVENTION

The object of the invention is to provide an-electronic cigarette without open fire but with real cigarette flavor, aiming at the defect of the prior art.

To achieve the purpose mentioned above, the technical solution of the present invention is as follows: an-electronic cigarette is provided, which includes a storage tank filled with extractant and an atomization device connected to the storage tank. The electronic cigarette further comprises a device for heating tobacco, which includes a heating mechanism and a heated chamber for loading cigarette or tobacco. The heating mechanism comprises a heating element and a heater circuit for controlling the heating element to be heated to a set temperature range. An inlet of the heated chamber is connected to an outlet of the atomization device, and an outlet of the heated chamber is connected with an opening for a suction nozzle. When the electronic cigarette is working, the extractant is atomized by the atomization device and then guided into the heated chamber. The heat produced by the heating element is applied to the cigarette or tobacco in the heated chamber to generate nicotine. After that, the nicotine and the atomized extractant are mixed together and then sucked out through the opening for the suction nozzle.

The extractant is one or more that is selected from water, propylene glycol, glycerin, vegetable glycerin and food flavoring.

The extractant is a mixture of organic solvent and food flavoring.

The set temperature range of the heating element is 100° C. to 580° C.

The outlet of the atomization device is connected to the heated chamber directly or through a pipe.

The heated chamber is a metal tube and the heating element is a heating wire. The heating wire is wrapped on the outer circumference surface of the metal tube and is further coated with a heat-insulating foam or heat-insulating paper from outside.

The atomization device comprises an atomizing housing loaded with oil absorbent, a heating coil, a top electrode, metal external thread and a top insulation ring. The oil absorbent inside the atomizing housing is connected to the storage tank. The top electrode is plugged into the metal external thread after it is surrounded with the top insulation ring. One end of the heating coil is connected with the top electrode while the other end of the heating coil is connected with the metal external thread. A metal internal thread, a lower electrode, a lower insulation ring, an insulation connection tube and a connection joint are further arranged between the metal external thread and the metal tube. The metal internal thread is in bolt connection with the metal external thread. The lower electrode is plugged into a central hole of the metal internal thread after it is surrounded with the lower insulation ring. The lower electrode is in contact with an internal electrode. Besides, an external electrode is connected with a positive pole of an atomization circuit, and the metal internal thread is connected with a negative pole of the atomization circuit. There are two through-holes in the center of the top electrode and lower electrode, respectively. In this way, one end of the insulation connection tube is connect to a chamber inside the atomizing housing through its engagement in the external polar; while the other end of the insulation connection tube is connected with an open end of the connection joint. A top opening of the connection joint is engaged into a bottom opening of the metal tube.

The heated chamber and the heating element are casted into a same heating barrel which is powered by a battery in the heater circuit.

The heated chamber is a metal tube and the heating element is a heating wire or a ceramic heating plate. The heating element is arranged at the bottom of the outer circumference surface of the metal tube. Both the metal tube and the heating element are coated with the heat-insulating foam or heat-insulating paper from outside.

The heater circuit comprises a rechargeable battery for powering the heating element.

Through the structure mentioned above, the nicotine in the cigarette or tobacco is vaporized by the device for heating tobacco at the temperature of 100° C. to 580° C., so that the nicotine and the extractant are mixed together into an atomized substance, while the tar and other harmful impurities still remain in the tobacco. In this way, the harm of smoking to human health is reduced as the smokers only inhale the-atomized mixture of the nicotine and the extractant into their lungs when smoking. Since the atomized nicotine-can be easily absorbed by the lung, most of the gas that smokers blow out is the extractant. Therefore, the environmental pollution and passive smoking for people around can be avoided. On the other hand, the existence of nicotine is sufficient to satisfy smokers' smoking addiction as well. In fact, the atomized has better taste. Besides, the possibility of fire or environmental pollution can be avoided due to the absence of open fire.

DESCRIPTION OF THE PREFERRED EMBODIMENTS

Figure 1:
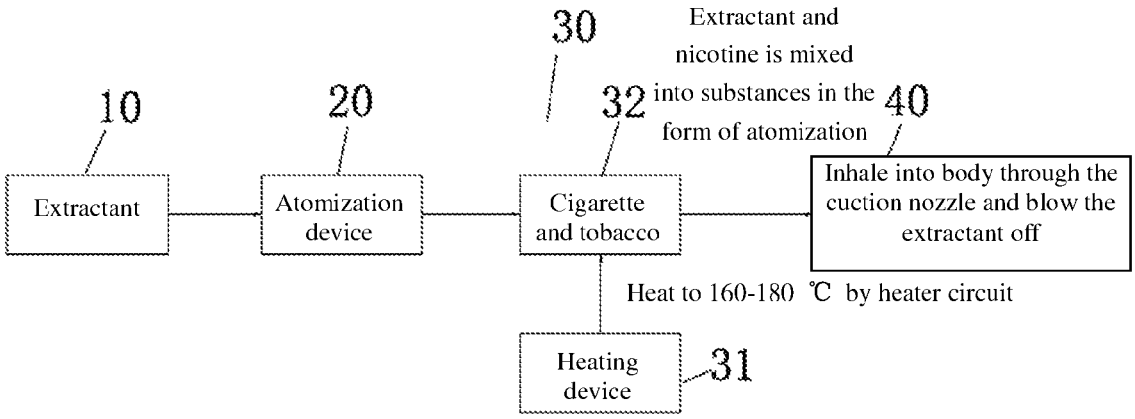
FIG. 1 is a block diagram illustrating a principle of the present invention.
Figure 2:
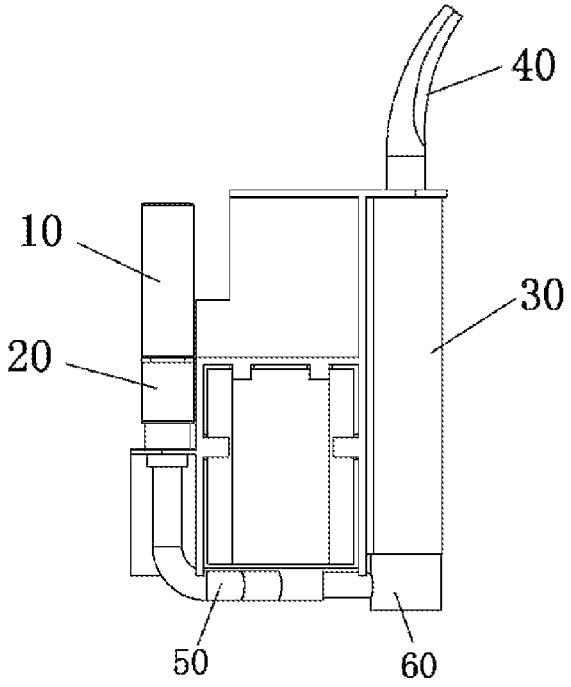
FIG. 2 is a schematic diagram of an embodiment of the present invention.

As shown in FIGS. 1-6, an electronic cigarette of the present invention is provided, which includes a storage tank 10 filled with extractant and an atomization device 20 connected the storage tank 10. The atomization device 20 is communicated with the extractant. The electronic cigarette further comprises a device for heating tobacco 30, which includes a heating mechanism 31 and a heated chamber 32 for loading cigarette or tobacco. The heating mechanism 31 comprises a heating element 311 and a heater circuit for controlling the heating element 311 to be heated to a set temperature range. An inlet of the heated chamber 32 is connected to an outlet of the atomization device 20, and an outlet of the heated chamber is connected with an opening for a suction nozzle 40. When the electronic cigarette is working, the extractant is atomized by the atomization device 20 and then guided into the heated chamber 32. The heat produced by the heating element 311 is applied to the cigarette or tobacco in the heated chamber 32 to generate nicotine. After that, the nicotine and the atomized extractant are mixed together and then sucked out through the opening for the suction nozzle 40.

The extractant is one or more that is selected from water, propylene glycol, glycerin, vegetable glycerin and food flavoring.

The extractant is a mixture of organic solvent and food flavoring.

The set temperature range of the heating element 311 is 100° C. to 180° C.

The outlet of the atomization device 20 is connected to the heated chamber 32 directly or through a pipe.

Figure 5:
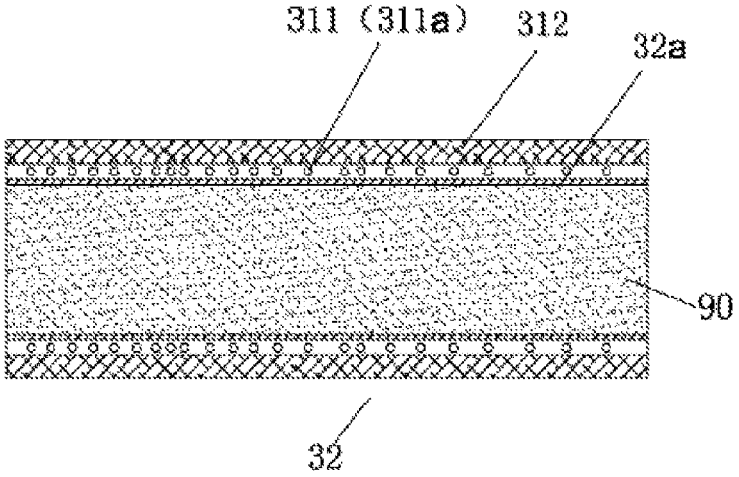
FIG. 5 is a first schematic diagram of a heated chamber of the present invention.

According to the structure as shown in FIG. 5, the heated chamber 32 is a metal tube 32*a* and the heating element 311 is a heating wire 311*a*. The heating wire 311*a* is wrapped on the outer circumference surface of the metal tube 32*a* and is coated with a heat-insulating foam or heat-insulating paper 312 from outside.

Figure 3:
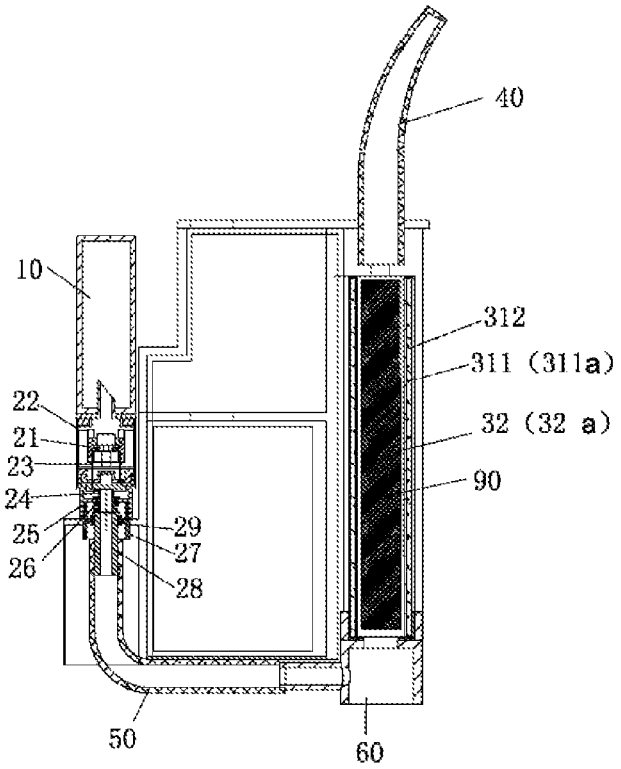
FIG. 3 is a cross-section diagram of an embodiment of the present invention.
Figure 4:
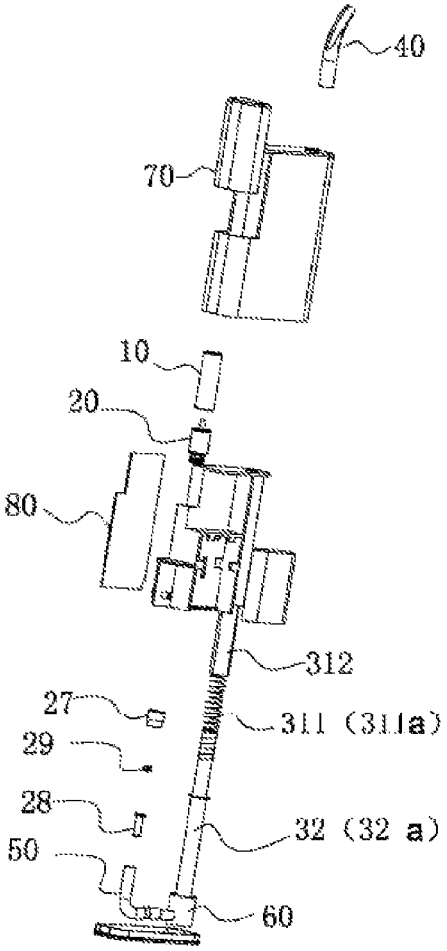
FIG. 4 is a three-dimensional exploded structure diagram of an embodiment of the present invention.

As shown in FIG. 3, the atomization device 20 comprises an atomizing housing 22 loaded with oil absorbent 21, a heating coil 23, a top electrode 24, metal external thread 25 and a top insulation ring 26. The oil absorbent 21 inside the atomizing housing 22 is connected to the storage tank 10. The top electrode 24 is plugged into the metal external thread 25 after it is surrounded with the top insulation ring 26. One end of the heating coil 23 is connected with the top electrode 24 and the other end of the heating coil is connected with the metal external thread 25. A metal internal thread 27, a lower electrode 28, a lower insulation ring 29, an insulation connection tube 50 and a connection joint 60 are further arranged between the metal external thread 25 and the metal tube 32*a*. The metal internal thread 27 is in bolt connection with the metal external thread 25. The lower electrode 28 is plugged into a central hole of the metal internal thread 27 after it is surrounded with the lower insulation ring 29. The top electrode 24 is in contact with an external electrode 28. Besides, the lower electrode 28 is connected with a positive pole of an atomization circuit, and the metal internal thread 27 is connected with a negative pole of the atomization circuit. There are two through-holes in the center of the top electrode 24 and the lower electrode 28, respectively. In this way, one end of the insulation connection tube 50 is connect to a chamber inside the atomizing housing 22 through its engagement in the external electrode 28; while the other end of the insulation connection tube is connected with an open end of the connection joint 60. A top opening of the connection joint 60 is engaged into a bottom opening of the metal tube 32*a*. In addition, the components in the embodiment of the present invention are arranged inside a casing 70, and the heater circuit and atomization circuit are arranged on a circuit board 80. The heated chamber 32 and the heating element 311 are casted into a same heating barrel which is powered by a battery in the heater circuit.

Figure 6:
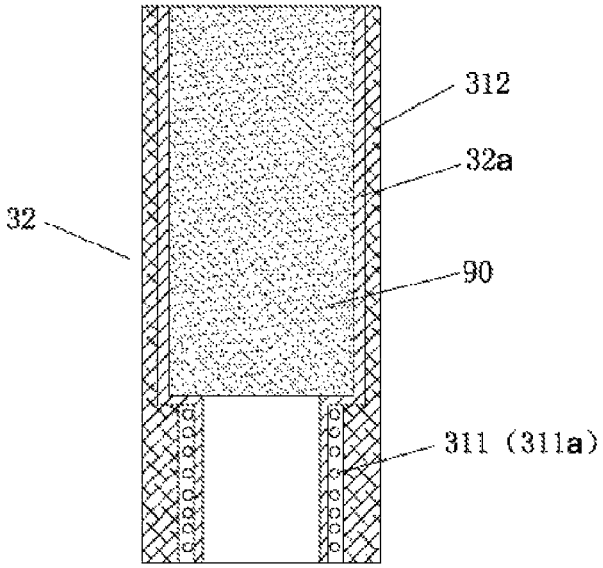
FIG. 6 is a second schematic diagram of a heated chamber of the present invention.

According to the structure as shown in FIG. 6, the heated chamber 32 is a metal tube 32*a* and the heating element 311 is a heating wire 311*a* or a ceramic heating plate. The heating element 311 is arranged at the bottom of the outer circumference surface of the metal tube 32*a*. Both the metal tube 32*a* and the heating element 311 are coated with the heat-insulating foam or heat-insulating paper 312 from outside.

The heater circuit comprises a rechargeable battery for powering the heating element 311.

INDUSTRIAL APPLICABILITY

The opening for the suction nozzle 40 can be pulled out so as to fill the metal tube 32*a* with cigarette or tobacco before using the electronic cigarette. In this embodiment the metal tube 32*a* is a steel tube or an aluminum tube. Then the switch of the electronic cigarette of the present invention is turned on, or alternatively its air switch can be turned on automatically when the electronic cigarette starts working. In this case, the power of the atomization circuit pass through the lower electrode 28, the top electrode 24, the heating coil 23, the metal external thread 25 and the metal internal thread 27 successively to form a loop. In this way, the heating coil 23 is enabled to generate heat. The extractant in the oil absorbent absorbed from the storage tank 10 is atomized by the heat generated. Then, the atomized extractant passes through the through-hole of the lower electrode 28, the through-hole of the top electrode 24, the insulation connection tube 50 and the connection joint 60 before it reaches the metal tube 32*a* in the device for heating tobacco 30. Here, the insulation connection tube 50 can be a soft plastic tube, and the metal tube 32*a* can be a steel tube or an aluminum tube. At that moment, the heater circuit enables the heating element 311 outside the steel tube or aluminum tube to work. It further controls the heating temperature inside the steel tube to be between the range of 100° C. to 180° C. through a temperature control device. In this way, the nicotine in the cigarette or tobacco 90 is vaporized while the tar and other harmful impurities still remain in the tobacco. As a result, the harm of smoking to human health is reduced. The nicotine and the atomized extractant are mixed together and then inhaled into smokers' lungs through the opening for the suction nozzle. Since the atomized nicotine can be easily absorbed by the lung, most of the gas that smokers blow out is the extractant. Therefore, the environmental pollution and passive smoking for people around can be reduced. On the other hand, the existence of nicotine is sufficient to satisfy smokers' smoking addiction as well. In fact, the nicotine in the form of atomization has better taste.

The solution adopted above is only one of the embodiments of the present invention. It is not intended to limit the scope of protection of the present invention. Instead, various simple modifications of the structure of the claims in the present invention should be within the scope of protection of the present invention.

The invention claimed is:

1. An electronic cigarette, including a storage tank filled with extractant and an atomization device connected to the storage tank, wherein the electronic cigarette further comprises a device for heating tobacco, which includes a heating mechanism and a heated chamber for loading cigarette or tobacco;

wherein the heating mechanism comprises a heating element and a heater circuit for controlling the heating element to be heated to a set temperature range;

wherein an inlet of the heated chamber is connected to an outlet of the atomization device, and an outlet of the heated chamber is connected with an opening for a suction nozzle;

wherein when the electronic cigarette is working, the extractant is atomized by the atomization device and then guided into the heated chamber;

wherein the heat produced by the heating element is applied to the cigarette or tobacco in the heated chamber to generate nicotine;

wherein the nicotine and atomized extractant are mixed together and then sucked out through the opening for the suction nozzle;

wherein the heated chamber is a metal tube and the heating element is a heating wire or a ceramic heating plate; the heating element is arranged at the bottom of the outer surface of the metal tube; and wherein the outer surfaces of both the metal tube and the heating element are coated with a heat-insulating foam or heat-insulating paper.

2. The electronic cigarette of claim 1, wherein the extractant is one or more that is selected from water, propylene glycol, glycerin, vegetable glycerin and food flavoring.

3. The electronic cigarette of claim 1, wherein the extractant is a mixture of organic solvent and food flavoring.

4. The electronic cigarette of claim 1, wherein the set temperature range of the heating element is 100° C. to 580° C.

5. The electronic cigarette of claim 1, wherein the outlet of the atomization device is connected to the heated chamber directly or through a pipe.

6. The electronic cigarette of claim 1, wherein the atomization device comprises an atomizing housing loaded with oil absorbent, a heating coil, a top electrode, a metal external thread and a top insulation ring; the oil absorbent inside the atomizing housing is connected to the storage tank;

wherein the top electrode is plugged into the metal external thread after it is surrounded with the top insulation ring;

wherein one end of the heating coil is connected with an internal electrode and the other end of the heating coil is connected with the metal external thread;

wherein a metal internal thread, a lower electrode, a lower insulation ring, an insulation connection tube and a connection joint are also arranged between the metal external thread and the metal tube;

wherein the metal internal thread is in bolt connection with the metal external thread;

wherein the lower electrode is plugged into a central hole of the metal internal thread after it is surrounded with the lower insulation ring;

wherein the top electrode is in contact with the lower electrode;

wherein the lower electrode is connected with a positive pole of an atomization circuit, and the metal internal thread is connected with a negative pole of the atomization circuit;

wherein two through-holes are arranged in the center of the internal electrode and an external electrode, respectively;

wherein one end of the insulation connection tube is connect to a chamber inside the atomizing housing through its engagement in the external electrode, the other end of the insulation connection tube is connected with an open end of the connection joint; and wherein a top opening of the connection joint is engaged into a bottom opening of the metal tube.

7. The electronic cigarette of claim 1, wherein the heated chamber and the heating element are casted into a same heating barrel which is powered by a battery in the heater circuit.

8. The electronic cigarette of claim 1, wherein the heater circuit comprises a rechargeable battery for powering the heating element.

* * * * *